US005897239A

United States Patent [19]

Caruthers, Jr. et al.

[11] Patent Number: 5,897,239

[45] Date of Patent: Apr. 27, 1999

[54] PHOTOMETRIC COLOR CORRECTION AND CONTROL SYSTEM FOR CUSTOM COLORS

[75] Inventors: Edward B. Caruthers, Jr., Rochester; James R. Larson, Fairport, both of N.Y.

[73] Assignee: Xerox Corporation, Stamford, Conn.

[21] Appl. No.: 08/831,454

[22] Filed: Mar. 31, 1997

[51] Int. Cl.[6] ..... G03G 15/01

[52] U.S. Cl. ..... 399/54; 399/39

[58] Field of Search ..... 399/54, 49, 39, 399/28, 223, 224; 430/117

[56] References Cited

U.S. PATENT DOCUMENTS

| | | | |
|---|---|---|---|
| 5,240,806 | 8/1993 | Tang et al. | 430/115 |
| 5,254,978 | 10/1993 | Beretta | 345/150 |
| 5,369,476 | 11/1994 | Bowers et al. | 355/256 |
| 5,471,313 | 11/1995 | Thieret et al. | 358/296 |
| 5,512,978 | 4/1996 | Mosher et al. | 355/203 |
| 5,519,497 | 5/1996 | Hubble, III et al. | 356/445 |
| 5,543,896 | 8/1996 | Mestha | 355/208 |
| 5,557,393 | 9/1996 | Goodman et al. | 355/326 |
| 5,713,062 | 1/1998 | Goodman et al. | 399/49 |

OTHER PUBLICATIONS

Xerox Disclosure Journal, vol. 21, No. 2 Mar./Apr., 1996, pp. 155–157.

*Primary Examiner*—Richard Moses

[57] ABSTRACT

A system and method for color mixing control in a developing material-based electrostatographic printing system. A developing reservoir containing an operative solution of customer selectable colored developing material is continuously replenished with selectively variable amounts of basic color components making up the operative solution by controlling the rate of replenishment of various color components added to the supply reservoir. An optical sensor is used to measure the optical spectrum of the developed image so that the actual optical spectrum thereof can be brought into agreement with a target optical spectrum associated with a customer selectable color. The present invention may be used to mix a customer selectable color in situ, whereby approximate amounts of primary color components are initially deposited and mixed in the developing material reservoir and the resultant developed image is monitored and adjusted until the mixture reaches a target optical spectrum. An additional optical sensor may be used to control and maintain the color of the developing material in the reservoir through continuous monitoring and correction in order to maintain a particular ratio of color components in the reservoir over extended periods associated with very long print runs.

25 Claims, 1 Drawing Sheet

PHOTOMETRIC COLOR CORRECTION AND CONTROL SYSTEM FOR CUSTOM COLORS

This invention relates generally to a control system for creating custom color images in a printing machine. This invention particularly concerns a system for providing photometric control of color mixing to match a customer-selected color, and more particularly, concerns a system for providing photometric customized color mixing and control in an electrostatographic printing system using dry or liquid developing materials. This invention enables continuous mixing and use of colors in many printing and painting systems. Examples include many forms of printing including (but not limited to) xerography, lithography, letterpress, gravure, and automobile painting. Although we will give many examples of the use of this invention in electrostatographic copying and printing, it should be remembered that this invention includes all uses of the methods disclosed for correcting and controlling the composition of a mixture of colorants.

Generally, the process of electrostatographic copying and printing is initiated by exposing a light image of an original input document or signal onto a substantially uniformly charged photoreceptive member. Exposing the charged photoreceptive member to a light image discharges selective areas of the photoreceptive member, creating an electrostatic latent image on the photoreceptive member corresponding to the original input document or signal. This latent image is subsequently developed into a visible image by a process in which developing material is deposited onto the surface of the photoreceptive member. Typically, the developing material comprises carrier granules having toner particles adhering triboelectrically thereto, wherein the toner particles are electrostatically attracted from the carrier granules to the latent image to create a powder toner image on the photoreceptive member. Alternatively, liquid developing materials comprising pigmented marking particles (or so-called toner solids) and charge directors dispersed in a carrier liquid have been utilized, wherein the liquid developing material is applied to the latent image with the marking particles being attracted toward the image areas to form a developed liquid image. Regardless of the type of developing material employed, the toner or marking particles of the developing material are electrostatically attracted to the latent image to form a developed image and the developed image is subsequently transferred from the photoreceptive member to a copy substrate, either directly or via an intermediate transfer member. Once on the copy substrate, the image may be permanently affixed to provide a "hard copy" output document. In a final step, the photoreceptive member is cleaned to remove any charge and/or residual developing material from the photoconductive surface in preparation for subsequent imaging cycles.

The above-described electrostatographic reproduction process is well known and is useful for so-called light lens copying from an original document, as well as for printing of electronically generated or stored images where the electrostatic latent image is formed via a modulated laser beam. Analogous processes also exist in other printing applications such as, for example, ionographic printing and reproduction where charge is deposited in image configuration on a charge retentive surface (see, for example, U.S. Pat. No. 4,267,556 and 4,885,220, among numerous other patents and publications). Some of these printing processes, such as light lens generated image systems operate in a manner wherein the charged areas are developed (so-called CAD, or "write white" systems), while other printing processes operate in a manner such that discharged areas are developed (so-called DAD, or "write black" systems). It will be understood that the instant invention applies to all various types of electrostatographic printing systems and is not intended to be limited by the manner in which the image is formed or developed.

It is well known that conventional electrostatographic reproduction processes can be adopted to produce multicolor images. For example, the charged photoconductive member may be sequentially exposed to a series of color separated images corresponding to the primary colors in an input image in order to form a plurality of color separated latent images. Each color separated image is developed with a complimentary developing material containing a primary color or a colorant which is the subtractive compliment of the color separated image, with each developed color separated image subsequently superimposed, in registration, on one another to produce a multicolor image output. Thus, a multicolor image is generated from patterns of different primary colors or their subtractive compliments which are blended by the eye to create a visual perception of a color image.

This procedure of separating and superimposing color images produces so-called "process color" images, wherein each color separated image comprises an arrangement of picture elements, or pixels, corresponding to a spot to be developed with toner particles of a particular color. The multicolor image is a mosaic of different color pixels, wherein the color separations are laid down in the form of halftone dots. In halftone image processing, the dot densities of each of the color components making up the multicolor image can be altered to produce a large variation of color hues and shades. For example, lighter tints can be produced by reducing the dot densities such that a greater amount of white from the page surface remains uncovered to reflect light to the eye. Likewise, darker shades can be produced by increasing the dot densities. This method of generating process color images by overlapping halftones of different colors corresponding to the primary colors or their subtractive equivalents is well known in the art and will not be further described herein.

With the capabilities of electrostatographic technology moving into multicolor imaging, advances have also been directed to the creation of so-called "highlight color" images, wherein independent, differently colored, monochrome images are created on a single output copy sheet, preferably in a single processing cycle. Likewise, "spot color" and/or "high-fidelity" color printing have been developed, wherein a printing system capable of producing process color output images is augmented with an additional developer housing containing an additional color beyond the primary or subtractive colors used to produce the process color output. This additional developer housing is used for developing an independent image with a specific color (spot color) or for extending the color gamut of the process color output (high fidelity color). As such, several concepts derived from conventional electrostatographic imaging techniques which were previously directed to monochrome and/or process color image formation have been modified to generate output images having selected areas that are different in color than the rest of the document. Applications of highlight spot and high fidelity color include, for example, emphasis on important information, accentuation of titles, and more generally, differentiation of specific areas of text or other image information.

One exemplary highlight color process is described in U.S. Pat. No. 4,078,929 to Gundlach, wherein independent images are created using a raster output scanner to form a tri-level image including a pair of image areas having different potential values and a non-image background area generally having a potential value intermediate the two image areas. As disclosed therein, the charge pattern is developed with toner particles of first and second colors, where the toner particles of one of the colors are positively charged and the toner particles of the other color are negatively charged, therefore producing a highlight color image.

One specific application of highlight color processing is customer selectable color printing, wherein a very specific highlight color is required. Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of custom color, which specifically refers to registered proprietary colors, such as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields nonuniformity of the color in the image area. Further, lines and text produced by halftone process color are very sensitive to misregistration of the multiple color images such that blurring, color variances, and other image quality defects may result.

As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof. This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions to produce a customer selectable color output.

Customer selectable color printing materials including paints, printing inks and developing materials can be manufactured by determining precise amounts of constituent basic color components making up a given customer selectable color material, providing precisely measured amounts of each constituent basic color component and thoroughly mixing these color components. This process is commonly facilitated by reference to a color guide or swatch book containing hundreds or even thousands of swatches illustrating different colors, wherein each color swatch is associated with a specific formulation of colorants. Probably the most popular of these color guides is published by Pantone®, Inc. of Moonachie, N.J. The Pantone® Color Formula Guide expresses colors using a certified matching system and provides the precise formulation necessary to produce a specific customer selectable color by physically intermixing predetermined concentrations of up to four colors from a set of up to 16 principal or basic colors. There are many colors available using the Pantone® system or other color formula guides of this nature that cannot be produced via typical halftone process color methods.

In the typical operational environment, an electrostatographic printing system may be used to print various customer selectable color documents. To that end, replaceable containers of premixed customer selectable color developing materials corresponding to each customer selectable color are provided for each print job. Replacement of the premixed customer selectable color or substitution of another premixed color between different print jobs necessitates operator intervention which typically requires manual labor, among other undesirable requirements. In addition, since each customer selectable color is typically manufactured at an off-site location, supplies of each customer selectable color printing ink must be separately stored for each customer selectable color print job.

The patent literature is replete with control systems for controlling electrostatographic processing parameters in response to the quality of the image produced by means of maintaining a test image or patch. For example, it is now common practice to provide a scanning device to sense optical density or other characteristics of a development test patch in order to generate a control response signal to adjust machine operation for print quality. Public demand for increased color quality and selectability has necessitated the development of various solutions and control mechanisms in response to particular requirements.

In a typical liquid developing material-based electrostatographic system, a liquid developing material reservoir is continuously replenished by the addition of various components making up the liquid developing material: namely liquid carrier, charge director, and a concentrated dispersion of toner particles in the carrier liquid, as necessary. This replenishment must be constantly monitored and controlled to provide a predetermined concentration of toner particles, liquid carrier, and charge director in the liquid developing material reservoir. The present invention builds on that concept by providing a system in which the color value of a printed customer selectable color image is monitored to control the rate of replenishment of various basic color components used to produce the customer selectable color material, thereby varying the concentration levels of each of the basic color components making up the customer selectable color material mixture in an operative material supply reservoir. Thus, the present invention contemplates a printing system including a color mixing and control system, wherein the color value of the material in a supply reservoir can be controlled and the rate of replenishment of various color components added to the supply reservoir can be selectively varied. By adding precise amounts of specific colors from a set of basic color components, the actual color of the material in the reservoir is brought into agreement with a predetermined selected color in order to produce a wide range of customer selectable colors. Moreover, by monitoring the output color of an image produced by the mixed color materials, and controlling the replenishment process in response thereto, a wide range of customer selectable colors can be produced and maintained over very long print runs.

It is desirable to print the full range of about 1000 custom colors which the Pantone Color Mixing System makes by combining 2–4 primary inks from the set of 16 Pantone primaries. Typically, two colors, such as green and yellow, are combined with either white or black. The colors are made lighter by including white ink in the custom color formulation or darker by including black ink. These custom colors are printed as solids, rather than as halftone patterns. Printing as a solid gives higher resolution than halftoning, especially for business graphics. Printing a solid layer of a combination color gives greater color purity, reduced print-to-print color variation and reduced Moire compared to overlapping halftone patterns of several colors.

The following disclosures may be relevant to some aspects of the present invention:

U.S. Pat. No. 5,557,393

Inventor: Goodman et al.

Issued: Sep. 17, 1996

U.S. Pat. No. 5,543,896

Inventor: Mestha

Issued: Aug. 6, 1996

U.S. Pat. No. 5,369,476

Inventor: Bowers et al.

Issued: Nov. 29, 1994

U.S. Pat. No. 5,240,806

Inventor: Tang et. al.

Issued: Aug. 31, 1993

U.S. Pat. No. 5,254,978

Inventor: Beretta

Issued: Oct. 19, 1993

U.S. Pat. No. 5,471,313

Inventor: Thieret et al.

Issued: Nov. 28, 1995

U.S. Pat. No. 5,512,978

Inventor: Mosher et al.

Issued: Apr. 30, 1996

U.S. Pat. No. 5,519,497

Inventor: Hubble et al.

Issued: May 21, 1996

The relevant portions of these referenced patents and disclosures may be briefly summarized as follows:

U.S. Pat. No. 5,557,393 discloses an electrostatographic imaging process including the formation of an electrostatic latent image on an image forming device, developing the electrostatic latent image on the image forming device with at least one developer containing carrier particles and a blend of two of more compatible toner compositions, and transferring the toner image to a receiving substrate and fixing it thereto. Among the compatible toner compositions that may be selected are toner compositions having blend compatible components coated on an external surface of the toner particles and particulate toner compositions containing therein blend compatible components or passivated pigments. Electrostatographic imaging devices, including a tri-level imaging device and a hybrid scavengeless development imaging device, are also provided for carrying out the described process. This process is especially useful in imaging processes for producing single color or highlight color images using customer selectable colors, or for adding highlight color to a process color image.

U.S. Pat. No. 5,543,896 discloses a method for measurement of tone reproduction curves using a single structured patch for providing development control by storing a reference tone reproduction curve and providing a single test pattern including a scale of pixel values in an interdocument zone on a photoreceptor surface. The test pattern is sensed in the interdocument zone and a control response to the sensing of the test pattern is provided with reference to the toner reproduction curve in order to adjust the machine operation for print quality correction.

U.S. Pat. No. 5,369,476 discloses a toner control system and method for electrographic printing in which toner is delivered from a reservoir to a toner fountain for application to an electrostatically charged sheet to form an image. The visual quality of the image is monitored, and toner concentrate is added to the toner in response to the monitored quality to increase the amount of pigment particles in the toner and to thereby maintain a substantially constant image quality. In the disclosed embodiments, a test image is formed outside the main image on the sheet, and the brightness of one or more predetermined colors in the test image is monitored.

U.S. Pat. No. 5,240,806 discloses a liquid color toner composition for use in contact and gap electrostatic transfer processes, wherein the toner comprises a colored predispersion including: a non-polymeric resin material having certain insolubility (and non-swellability), melting point, and acid number characteristics; and alkoxylated alcohol having certain insolubility (and non-swellability) and melting point characteristics; and colorant material having certain particle size characteristics. The toner further comprises an aliphatic hydrocarbon liquid carrier having certain conductivity, dielectric constant, and flash point.

U.S. Pat. No. 5,254,978 teaches a reference color selection system for creating a palette of calorimetrically measured colors. Palettes of colorimetrically measured colors representing naturally occurring objects and specified using a standard device independent color specification, such as the CIE color specification are arranged in a data base. A simple to use color sections user interface permits a user to retrieve, view and modify each palette. Each color is transformed into coordinates in a uniform color space, such as the CIELab space. The user may delete colors not needed and may create new colors for the palette by mixing two existing palette colors together.

U.S. Pat. No. 5,471,313 uses a control system for an image output terminal with a hierarchical structure which isolates subsystem controls for purposes of efficient algorithm design, analysis and implementation. The architecture is divided into three levels and has a controls supervisor which provides subsystem isolation functions and reliability assurance functions. The architecture improves image quality of IOT outputs by controlling the operation of the IOT to insure that a tone reproduction curve of an output image matches a tone reproduction curve of an input image, despite several uncontrollable variables which change the tone reproduction curve of the output image.

U.S. Pat. No. 5,512,978 discloses an apparatus for measuring concentrations of a first vapor pressure carrier fluid component and a second vapor pressure carrier fluid component in a carrier fluid mixture including a supply vessel for holding the carrier fluid mixture. A light source is provided for transmitting an infrared light source to the carrier fluid mixture. A detector is provided for detecting infrared light intensity transmitted through the carrier fluid mixture and in response thereto determining infrared absorption of carbon hydrogen stretching frequencies of the carrier fluid mixture. The concentrations of the first carrier fluid components and the second carrier fluid component are calculated based on the infrared absorption of carbon hydrogen stretching frequencies of the carrier fluid mixture. This method can also be extended to a mixture of more than two fluids.

U.S. Pat. No. 5,519,497 teaches an infrared densitometer which measures the diffuse component of reflectivity as marking particles are progressively deposited on a moving photoconductive belt. Collimated light rays are projected onto a test patch including the marking particles. The light rays reflected from the test patch are collected and directed onto a photodiode array. The photodiode array generates electrical signals proportional to the total flux and a diffuse component of the total flux of the reflected light rays. Circuitry compares the electrical signals and determines the difference to generate an electrical signal proportional to the specular component of the total flux of the reflected light rays. Additional circuitry adds the electrical signals proportional to the total flux and the diffuse component of the total flux of the reflected light rays and compares the result of the summed signal to the specular component to provide a total diffuse signal for controlling developed mass.

Xerox Disclosure Journal, Vol. 21, No. 2, pp. 155–157 discloses customer selectable color liquid ink development and a customer selectable color liquid ink development process wherein two or more liquid colored inks are applied simultaneously, in proper predetermined relative amounts, to provide custom or customer specified color images. The processes comprise, for example, providing a liquid development apparatus with at least one developer housing containing a liquid developer comprised of at least two different colored inks that are premixed at a desired concentration ratio, and developing a latent image with the premixed liquid developer to afford customer selectable colored developed images.

"Color Mixing and Control System for use in an Electrostatographic Printing Machine" by Goodman et al., U.S. Ser. No. 08/721,420, filed Sep. 26, 1996 and assigned to the same assignee as the present patent application teaches an operative mixture of colored developing material which is continuously replenished with selectively variable amounts of developing materials of basic color components making up the operative mixture. The rate of replenishment of various color components added to the operative mixture is controlled to provide a mixture of developing material capable of producing a customer selectable color on an output copy substrate. A colorimeter is provided for monitoring the color of a test image printed with the operative mixture of developing material in the supply reservoir so that the color thereof can be brought into agreement with a color required to produce the customer selectable output color.

"Color Mixing and Control System for use in an Electrostatographic Printing Machine" by Caruthers, Jr. et al. filed Sep. 26, 1996, U.S. Pat. Ser. No. 08/721,419 and assigned to the same assignee as the present invention discloses a developing reservoir containing an operative solution of customer selectable colored developing material that is continuously replenished with selectively variable amounts of basic color components making up the operative solutions by controlling the rate of replenishment of various color components added to the supply reservoir. A spectrophotometer is used to measure the optical spectrum of the developing material in the supply reservoir so that the actual optical spectrum thereof can be brought into agreement with a target optical spectrum associated with a customer selectable color.

"Color and Replenishment System for an Electrostatographic Printing Machine" by Caruthers, Jr. et al. filed Sep. 26, 1996, U.S. Pat. Ser. No. 08/721,422 and assigned to the same assignee as the present invention includes a system and method for color mixing in which a developing material reservoir containing an operative solution of colored developing material including a mixture of selected color components is continuously replenished with selected differently colored developing material concentrates in a predetermined ratio so as to be capable of producing a customer selectable color image area on an output substrate. The system may also be used to mix a customer selectable color in situ either from stored proportions known to compensate for developablity differences or from approximate amounts of primary color components initially deposited and mixed in the developing material reservoir with the resultant operative developing material mixture continually developed and replenished with a predetermined ratio of color components until the developing material mixture reaches a steady state color.

"Apparatus for Detecting Marking Material" by Denton, U.S. Ser. No. 08/655,587, filed May 30, 1996 and assigned to the same assignee as the present invention teaches an apparatus which detects a mass of marking material developed on a test patch recorded on a photoconductive surface. The apparatus includes a densitometer, a capacitor sensor and a controller. In operation, the densitometer generates a first signal proportional to the specular component of the total reflectivity of the material deposited on the test patch developed on the photoconductive surface. The capacitor sensor generates a second signal proportional to the mass of material developed on the test patch recorded on the surface. In response to these signals, the controller generates a second signal proportional to the mass of material deposited on the test patch being less than a preselected mass. When the mass deposited on the test patch is greater than the preselected mass, the controller generates a second control signal as a function of the second signal received from the capacitor sensor. In this way, a continuous signal is transmitted from the controller independent of the color of the material developed on the test patch.

"Capacitive Based Sensing System for use in a Printing System" by Rathbun, et al., U.S. Ser. No. 08/715,268, filed Sep. 16, 1996 discloses a sensing system in which a print is developed with developer material and development of the print varies as a function of both a first parameter and a second parameter. The development system includes a capacitance and the sensing system, which measures a first value varying as a function of the first parameter and a second value varying as a function of the second parameter, includes a sensing subsystem for measuring an output by reference to the capacitance; and a signal development subsystem, responsive to the sensing system, for developing from the output both a first signal and a second signal corresponding to the second value.

All of the above cited references are hereby incorporated by reference.

SUMMARY OF THE INVENTION

One aspect of the invention is drawn to a system for providing an operative color material for producing a customer selectable color, including a plurality of color material supply dispensers, each containing a different color concentrate corresponding to a basic color component of a color matching system; a color material reservoir for providing an operative supply of color material for printing the specified color, the reservoir having each of color material supply dispensers coupled thereto; and a system for systematically dispensing a selective amount of color material concentrate from at least a selected one of the color material supply dispensers to the color material reservoir for providing a selected amount of a selected basic color component to the supply of operative color material. A first optical sensing device monitors the color of a printed image produced by the operative color material reservoir and a control system is coupled to the first optical sensing device for selectively actuating the systematic dispensing system in response to the sensed color of the developed image to adjust the operative color developing material so as to produce the customer selectable color output image.

Another aspect of the invention is drawn to a system for providing an operative color developing material for developing an image for producing a customer selectable color output image. In the system, there are a plurality of developing material supply dispensers, each containing a different color developing material concentrate corresponding to a basic color component of a color matching system; a developing material reservoir for providing an operative supply of developing material for developing the electrostatic latent image so as to generate the output print of a specified color, the reservoir having each of developing material supply dispensers coupled thereto; and a system for systematically dispensing a selective amount of developing material concentrate from at least a selected one of the developing material supply dispensers to the developing material reservoir for providing a selected amount of a selected basic color component to the supply of operative developing material. A first optical sensing device monitors the color of a developed image produced by the operative developing material reservoir and a control system is coupled to the optical sensing device for selectively actuating the systematic dispensing system in response to the sensed color of the developed image to adjust the operative color developing material so as to produce the customer selectable color output image.

Yet another aspect of the invention is drawn to a method for providing an operative color developing material for developing an image for producing a customer selectable color output image. The method includes dispensing different color developing material concentrates from a plurality of developing material supply dispensers, each dispenser containing a different color developing material concentrate corresponding to a basic color component of a color matching system; supplying an operative developing material to a developing material reservoir for providing an operative supply of developing material for developing the image so as to generate the output print of a specified color, the reservoir having each of developing material supply dispensers coupled thereto. The color of the developed image produced by the operative developing material is monitored with a first optical sensing device and the dispensed amount of developing material concentrate from at least a selected one of the developing material supply dispensers to the developing material reservoir is selectively controlled for providing a selected amount of a selected basic color component to the supply of operative developing material with a control system coupled to the first optical sensing device for selectively actuating the systematic dispensing system in response to the sensed color of the developed image to adjust the operative color developing material so as to produce the customer selectable color output image.

In the example of a xerographic printer using liquid toner, a multi-component liquid xerographic developer is controlled by measuring the color of either (1) a developed image on a photoreceptor or intermediate transfer belt or (2) a printed patch on the final substrate. This control may be enhanced by also measuring the color of the mixed developer material. The mixed developer is a liquid xerographic toner with 1–2 primary colors (blue, red, yellow, . . . ) and black or white. The printed patch is measured on the final substrate including paper, transparency, packaging, etc. or on an intermediate surface such as a photoreceptor or transfer belt. The color is measured in the CIELAB coordinates, L*, a*, b*. It has been found that including white or black in the mixed developer material changes not only the lightness L* of the color, but also a* and b*. The present invention provides a very detailed method for measuring the mixed developer, developed image or printed color and calculating the changes needed in the mixed developer to obtain the desired printed color. Knowledge of the colors of the individual components and of the target color is combined with the current measurement to derive corrections which need to be made to the developer components.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
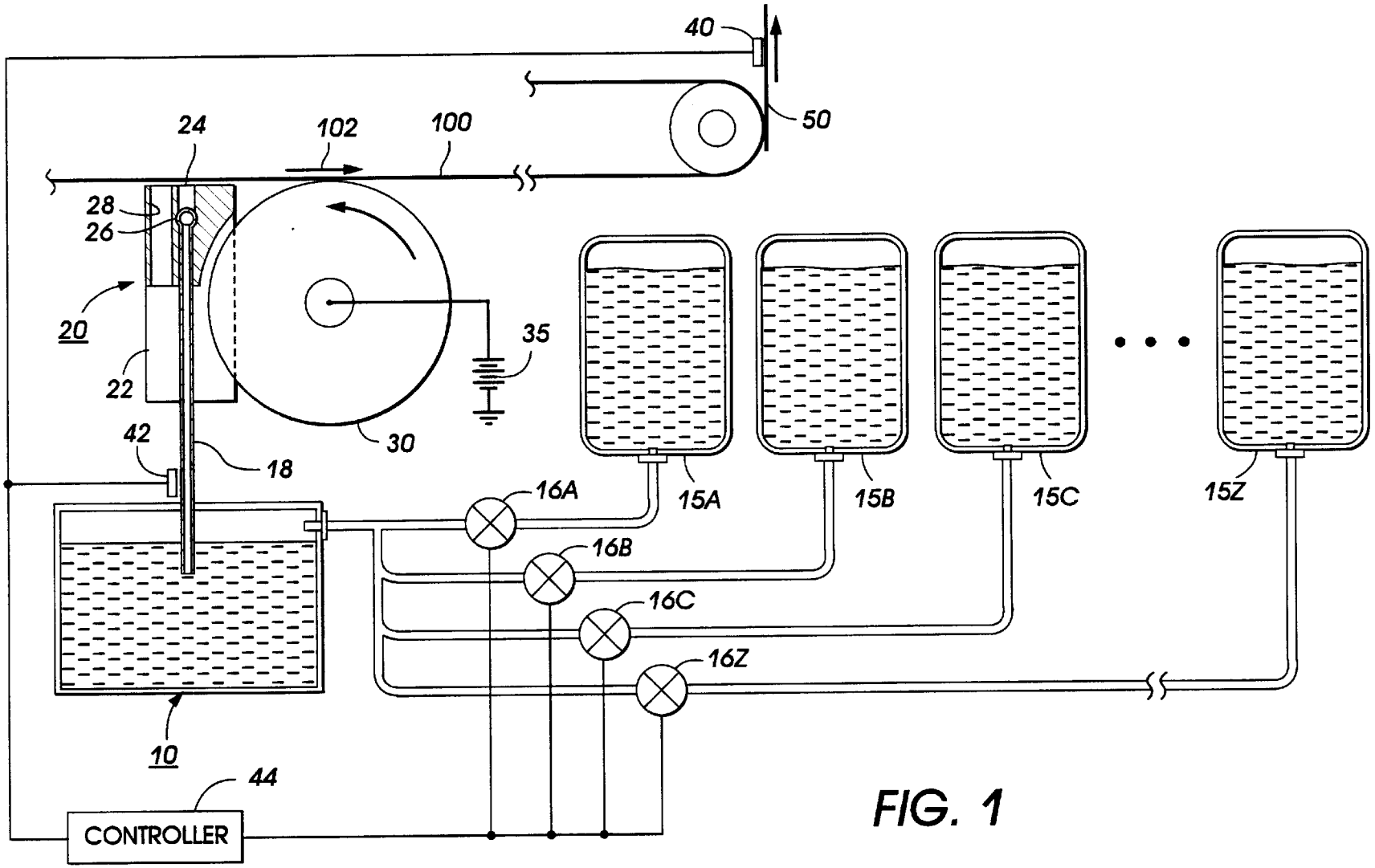
FIG. 1 shows a schematic view of an electrostatographic developing station for developing an electrostatic latent image.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Since the art of electrostatographic printing is well known, it is noted that several concepts for electrostatographic highlight, spot and/or high fidelity color imaging systems which could make beneficial use of the color mixing and control system of the present invention have been disclosed in the relevant patent literature. One of the more elegant and practical of these concepts is directed toward single-pass highlight color tri-level imaging. In general, tri-level imaging involves the creation of two different electrostatic latent images at different voltage levels generated in a single imaging step, with a background or non-image area at yet another intermediate voltage level. Typically, one latent image is developed using charged-area development (CAD) techniques, while the other is developed via discharged-area development (DAD) techniques. This is accomplished by using positively charged toner for one color and negatively charged developing materials for the other, in separate housings. For example, by providing one developing material in black and the other in a selected color for highlighting, two different color images can be created on a single output document in a single processing cycle. This concept for tri-level xerography, is disclosed in U.S. Pat. No. 4,078,929, issued in the name of Gundlach, incorporated by reference herein. As disclosed therein, tri-level xerography involves the modification of known xerographic processes, such that the xerographic contrast on the charge retentive surface or photoreceptor is divided three ways, rather than two, as in the case in conventional xerography. Thus the photoreceptor is imagewise exposed such that one image, corresponding to charged image areas, is maintained at the full photoreceptor potential (V ddp or V cad) while the other image, which corresponds to discharged image areas is exposed to discharge the photoreceptor to its residual potential, i.e. V dad. The background areas are formed by exposing areas of the photoreceptor at V ddp to reduce the photoreceptor potential to halfway between the V cad and V dad potentials, and is referred to as Vw or V white.

While the present invention may find particular application in tri-level highlight color imaging, it will become apparent from the following discussion that the color mixing and control system of the present invention may be equally well-suited for use in a wide variety of printing machines and is not necessarily limited in its application to the particular single-pass highlight tri-level electrostatographic process described by Gundlach. In fact, it is intended that the color mixing and control system of the present invention may be extended to any printing or painting process intended to produce a customer selectable color image area including multi-color printing machines which may be provided with an ancillary customer selectable color development housing, as well as printing machines which carry out ionographic printing processes and the like. More generally, while the color mixing and control system of the present invention will hereinafter be described in connection with one of numerous various embodiments thereof, it will be understood that the description of the invention is not intended to limit the scope of the present invention to this preferred embodiment. On the contrary, the present invention is intended to cover all alternatives, modifications, and equivalents as may be included within the spirit and scope of the invention as defined by the appended claims.

Turning now to FIG. 1, an exemplary apparatus for developing an electrostatic latent image, wherein liquid developing materials are utilized is depicted in schematic form. Typically, a highlight color electrostatographic printing machine would include at least two developing apparatus operating with different color liquid developing materials for developing laten image areas into different colored visible images. By way of example, in a tri-level system of the type described hereinabove, a first developer apparatus might be utilized to develop the positively charged image area with black colored liquid developing material, while a second developer apparatus might be used to develop the negatively charged image area image with a customized color. In the case of liquid developing materials, each different color developing material comprises pigmented toner or marking particles, as well as charge control additives and charge directors, all disseminated through a liquid carrier, wherein the marking particles are charged to a polarity opposite in polarity to the charged latent image to be developed.

The developing apparatus of FIG. 1 operates primarily to transport liquid developer material into contact with a latent image on a photoreceptor surface, generally identified by reference numeral 100, wherein the marking particles are attracted, via electrophoresis, to the electrostatic latent image for creating a visible developed image thereof. With respect to the developing material transport and application process, the basic manner of operation of each developer apparatus is generally identical to one another and the developing apparatus shown in FIG. 1 represents only one of various known apparatus that can be utilized to apply liquid developing material to the photoconductive surface. It will be understood that the basic development system incorporating the mixing and control system of the present invention may be directed to liquid or dry powder development, and may take many forms, as for example, systems described in U.S. Pat. Nos. 3,357,402; 3,618,552; 4,733,273; 4,883,018; 5,270,782 and 5,355,201 among numerous others. Such development systems may be utilized in a multicolor electrophotographic printing machine, a highlight color machine, or in a monochromatic printing machine. In general, the only distinction between each developer unit is the color of the liquid developing material therein. It will be recognized however, that only developer applicators which require the capability of generating customer selectable color outputs will be provided with the customer selectable color mixing and control system of the present invention.

Focusing on the development process before describing the color mixing and control system of the present invention, in the exemplary developing apparatus of FIG. 1, liquid developing material is transported from a supply reservoir 10 to the latent image on the photoreceptor 100 via a liquid developing material applicator 20. Supply reservoir 10 acts as a holding receptacle for providing an operative solution of liquid developing material comprised of liquid carrier, a charge director compound, and toner material, which, in the case of the customer selectable color application of the present invention, includes a blend of different colored marking particles. In accordance with the present invention, a plurality of replaceable supply dispensers 15A–15Z, each containing a concentrated supply of marking particles and carrier liquid corresponding to a basic color component in a color matching system, are provided in association with the operational supply reservoir 10 and coupled thereto for replenishing the liquid developing material therein, as will be described.

The exemplary developing material applicator 20 includes a housing 22, having an elongated aperture 24 extending along a longitudinal axis thereof so as to be oriented substantially transverse to the surface of photoreceptor 100, along the direction of travel thereof as indicated by arrow 102. The aperture 24 is coupled to an inlet port 26 which is further coupled to reservoir 10 via transport conduit 18. Transport conduit 18 operates in conjunction with aperture 24 to provide a path of travel for liquid developing material being transported from reservoir 10 and also defines a developing material application region in which the liquid developing material can freely flow in order to contact the surface of the photoreceptor belt 100 for developing the latent image thereon. Thus, liquid developing material is pumped or otherwise transported from the supply reservoir 10 to the applicator 20 through at least one inlet port 26, such that the liquid developing material flows out of the elongated aperture 24 and into contact with the surface of photoreceptor belt 100. An overflow drainage channel (not shown), partially surrounding the aperture 24, may also be provided for collecting excess developing material which may not be transferred over to the photoreceptor surface during development. Such an overflow channel would be connected to an outlet channel 28 for removal of excess or extraneous liquid developing material and, preferably, for directing this excess material back to reservoir 10 or to a waste sump whereat the liquid developing material can preferably be collected and the individual components thereof can be recycled for subsequent use.

Slightly downstream of and adjacent to the developing material applicator 20, in the direction of movement of the photoreceptor surface 100, is an electrically biased developer roller 30, the peripheral surface thereof being situated in close proximity to the surface of the photoreceptor 100. The developer roller 30 rotates in a direction opposite the movement of the photoconductor surface 100 so as to apply a substantial shear force to the thin layer of liquid developing material present in the area of the nip between the developer roller 30 and the photoreceptor 100, for minimizing the thickness of the liquid developing material on the surface thereof. This shear force removes a predetermined amount of excess liquid developing material from the surface of the photoreceptor and transports this excess developing material in the direction of the developing material applicator 20. The excess developing material eventually falls away from the rotating metering roll for collection in the reservoir 10 or a waste sump (not shown). A DC power supply 35 is also provided for maintaining an electrical bias on the metering roll 30 at a selected polarity and magnitude such that image areas of the electrostatic latent image on the photoconductive surface will attract marking particles from the developing material for developing the electrostatic latent image. This electrophoretic development process minimizes the existence of marking particles in background regions and maximizes the deposit of marking paricles in image areas on the photoreceptor.

In operation, liquid developing material is transported in the direction of the photoreceptor 100, filling the gap between the surface of the photoreceptor and the liquid developing material applicator 20. As the belt 100 moves in the direction of arrow 102, a portion of the liquid developing material in contact with the photoreceptor moves therewith toward the developing roll 30 where marking particles in the liquid developer material are attracted to the electrostatic latent image areas on the photoreceptor. The developing roller 30 also meters a predetermined amount of liquid developing material adhering to the photoconductive surface of belt 100 and acts as a seal to prevent extraneous liquid developing material from being carried on by the photoreceptor.

As previously indicated, the liquid developing materials of the type suitable for electrostatographic printing applications generally comprise marking particles and charge directors dispersed in a liquid carrier medium, with an operative solution of the developing material being stored in reservoir 10. Generally, the liquid carrier medium is present in a large amount in the liquid developing material composition, and constitutes that percentage by weight of the developer not accounted for by the other components. The liquid medium is usually present in an amount of from about 80 to about 99.5 percent by weight, although this amount may vary from this range provided that the objectives of the present invention can be achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as Norpar® 12, Norpar® 13, and Norpar® 15, and including isoparaffinic hydrocarbons such as Isopar® G, H, L, and M, available from Exxon Corporation. Other examples of materials suitable for use as a liquid carrier include Amsco® 460 Solvent, Amsco® OMS, available from American Mineral Spirits Company, Soltrol®, available from Phillips Petroleum Company, Pagasol®, available from Mobil Oil Corporation, Shellsol®, available from Shell Oil Company, and the like. Isoparaffinic hydrocarbons provide a preferred liquid media, since they are colorless, and environmentally safe.

The marking or so-called toner particles of the liquid developing material can comprise any particle material compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, among others, the disclosures of each of which are totally incorporated herein by reference. Preferably, the toner particles should have an average particle diameter ranging from about 0.2 to about 10 microns, and most preferably between about 0.5 and about 2 microns. The toner particles may be present in the operative liquid developing material in amounts of from about 0.5 to about 20 percent by weight, and preferably from about 1 to about 4 percent by weight of the developer composition. The toner particles can consist solely of pigment particles, or may comprise a resin and a pigment; a resin and a dye; or a resin, a pigment, and a dye or resin alone. Other agents including charge adjuvants (also called charge control agents, abbreviated CCAs) may be optionally included.

Examples of thermoplastic resins include ethylene vinyl acetate (EVA) copolymers, (ELVAX® resins, E.I. DuPont de Nemours and Company, Wilmington, Del.); copolymers of ethylene and an a-b-ethylenically unsaturated acid selected from the group consisting of acrylic acid and methacrylic acid; copolymers of ethylene (80 to 99.9 percent), acrylic or methacrylic acid (20 to 0.1 percent)/alkyi (C1 to C5) ester of methacrylic or acrylic acid (0.1 to 20 percent); polyethylene; polystyrene; isotactic polypropylene (crystalline); ethylene ethyl acrylate series available under the trademark BAKELITE® DPD 6169, DPDA 6182 NATURALÔ (Union Carbide Corporation, Stamford, Conn.); ethylene vinyl acetate resins like DQDA 6832 Natural 7 (Union Carbide Corporation); SURLYN® ionomer resin (E.I. DuPont de Nemours and Company); or blends thereof; polyesters; polyvinyl toluene; polyamides; styrene/lbutadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); and other acrylic resins including ELVACITE® acrylic resins (E.I. DuPont de Nemours and Company); or blends thereof. Preferred copolymers selected in embodiments are comprised of the copolymer of ethylene and an a-b-ethylenically unsaturated acid of either acrylic acid or methacrylic acid. In a preferred embodiment, NUCREL® resins available from E.I. DuPont de Nemours and Company like NUCREL 599®, NUCREL 699®, or NUCREL 960® are selected as the thermoplastic resin.

In embodiments, the marking particles are comprised of thermoplastic resin, a charge adjuvant, and the pigment, dye, or other colorant. Therefore, it is important that the thermoplastic resin and the charge adjuvant be sufficiently compatible that they do not form separate particles, and that the charge adjuvant be insoluble in the hydrocarbon liquid carrier to the extent that no more than 0.1 weight percent be soluble therein. Any suitable charge director such as, for example, a mixture of phosphate ester and aluminum complex can be selected for the liquid developers in various effective amounts, such as, for example, in embodiments from about 1 to 1,000 milligrams of charge director per gram of toner solids and preferably 10 to 100 milligrams/gram. Developer solids include toner resin, pigment, and optional charge adjuvant.

Liquid developing materials generally contain a colorant dispersed in the resin particles. Colorants, such as pigments or dyes like black, white, cyan, magenta, yellow, red, blue, green, brown, and mixtures wherein any one colorant may comprise from 0.1 to 99.9 weight percent of the colorant mixture with a second colorant comprising the remaining percentage thereof are preferably present to render the latent image visible. The colorant may be present in the resin particles in an effective amount of, for example, from about 0.1 to about 60 percent, and preferably from about 10 to about 30 percent by weight based on the total weight of solids contained in the developer. The amount of colorant selected may vary depending on the use of the developer; for instance, if the toned image is to be used to form a chemical resist image no pigment is necessary. Clear, unpigmented toner particles may be included in the developer material to lighten the images printed. Examples of colorants such as pigments which may be selected include carbon blacks available from, for example, Cabot Corporation (Boston, Mass.), such as MONARCH 1300®, REGAL 330® and BLACK PEARLS® and color pigments like FANAL PINK®, PV FAST BLUE®, Titanium Dioxide (white) and Paliotol Yellow D1155; as well as the numerous pigments listed and illustrated in U.S. Pat. Nos. 5,223,368; 5,484,670, the disclosures of which is totally incorporated herein by reference.

As previously discussed, in addition to the liquid carrier vehicle and toner particles which typically make up the liquid developer materials, a charge director compound (sometimes referred to as a charge control additive) is also provided for facilitating and maintaining a uniform charge on the marking particles in the operative solution of the liquid developing material by imparting an electrical charge of selected polarity (positive or negative) to the marking particles.

Examples of suitable charge director compounds and charge control additives include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The use of quaternary charge directors as disclosed in the patent literature may also be desirable. The charge control additive may be present in an amount of from about 0.01 to about 3 percent by weight, and preferably from about 0.02 to about 0.20 percent solids by weight of the developer composition.

The application of developing material to the photoconductive surface clearly depletes the overall amount of the operative solution of developing material in supply reservoir 10. In the case of the liquid developing materials, marking particles are depleted in the image areas; carrier liquid is depleted in the image areas (trapped by marking particles) and in background areas, and may also be depleted by evaporation; and charge director is depleted in the image areas (trapped in the carrier liquid), in the image areas adsorbed onto marking particles, and in the background areas. In general practice, therefore, reservoir 10 is continuously replenished, as necessary, by the addition of developing material or selective components thereof, for example in the case of liquid developing materials, by the addition of liquid carrier, marking particles, and/or charge director into the supply reservoir 10. Since the total amount of any one component making up the developing material utilized to develop the image may vary as a function of the area of the developed image areas and the background portions of the latent image on the photoconductive surface, the specific amount of each component of the liquid developing material which must be added to the supply reservoir 10 varies with each development cycle. For example, a developed image having a large proportion of printed image area will cause a greater depletion of marking particles and/or charge director from a developing material reservoir as compared to a developed image with a small amount of printed image area.

Thus, it is known in the art that, while the rate of the replenishment of the liquid carrier component of the liquid developing material may be controlled by simply monitoring the level of liquid developer in the supply reservoir 10, the rate of replenishment of the marking particles, and/or the charge director components of the liquid developing material in reservoir 10 must be controlled in a more sophisticated manner to maintain a predetermined concentration of the marking particles and the charge director in the operative solution stored in the supply reservoir 10. Systems have been disclosed in the patent literature and otherwise for systematically replenishing individual components making up the liquid developing material (liquid carrier, marking particles and/or charge director) as they are depleted from the reservoir 10 during the development process. See, for example, commonly assigned U.S. patent application Ser. No. 08/551,381 and the references cited therein.

The present invention, however, contemplates a liquid developing material replenishing system capable of systematically replenishing individual color components making up a customer selectable color liquid developing material composition. As such, the replenishment system of the present invention includes a plurality of differently colored developing material supply dispensers 15A, 15B, 15C, . . . 15Z, each coupled to the operative supply reservoir via an associated valve member 16A, 16B, 16C, . . . 16Z, or other appropriate liquid flow control device. Preferably, each supply dispenser contains a developing material concentrate of a known basic or primary color such as Cyan, Magenta, and Yellow. In one specific embodiment, the replenishment system includes sixteen supply dispensers, wherein each supply container provides a different basic color liquid developing material corresponding to the sixteen basic or constituent colors of the Pantone® Color Matching System. This embodiment contemplates that color formulations conveniently provided by the Pantone® System can be utilized to produce about a thousand desirable colors and shades in a customer selectable color printing environment. Using this system, as few as two different color liquid developing materials, from supply containers 15A and 15B for example, can be combined in reservoir 10 to expand the color gamut of customer selectable colors far beyond the colors available via halftone imaging techniques.

An essential component of the developing material color mixing and control system of the present invention is a color control system. That is, since different components of the blended liquid developing material in reservoir 10 may develop at different rates, a customer selectable color mixing controller 44 is provided in order to determine appropriate amounts of each color liquid developing material in supply containers 15A, 15B . . . or 15Z which can be systematically added to supply reservoir 10, and to controllably supply each of such appropriate amounts of liquid developing material. Controller 44 may take the form of any known microprocessor based memory and processing device, as are well known in the art.

The approach provided by the color mixing control system of the present invention includes a developed image sensing device 40, and, optionally, a mixed developer sensing device 42; for example, optical sensors for respectively monitoring the color of the developed image which has been transferred to output copy substrate 50 and the liquid developing material in the reservoir 10. While sensing device 40 is shown monitoring the output color of the developed image transferred to the output copy substrate 50, sensor 40 could also be positioned to sense the developed image on the photoreceptor 100 or an intermediate transfer belt (not shown). Likewise, while sensing device 42 is shown in FIG. 1 in a position so as to monitor the liquid developing material being transported from the liquid developing material reservoir 10 to the developing material applicator 20, it will be understood by those of skill in the art that various multi-wavelength light attenuation sensors may be utilized to detect the color of the liquid developing material including devices which are submerged in the liquid developing material reservoir 10, or devices which monitor the light attenuation across the entire volume of the reservoir 10. Sensors 40 and 42 are connected to controller 44 for controlling the flow of the variously colored replenishing liquid developing materials from dispensers 15A–15Z, corresponding to the basic constituent colors of a color matching system, to be delivered into the liquid developing material supply reservoir 10 from each of the supply containers 15A–15Z. In a preferred embodiment, as shown in FIG. 1, the controller 44 is coupled to control valves 16A–16Z for selective actuation thereof to control the flow of liquid developing material from each supply container 15A–15Z. It will be understood that these valves may be replaced by pump devices or any other suitable flow control mechanisms as known in the art, so as to be substituted thereby.

In one particular embodiment of the present invention, sensors 40 and 42 are provided in the form of spectrophotometers of the type well known in the art, such that spectrographic methods can be utilized to provide color mixing control. A spectrophotometer measures the transmission or apparent reflectance of visible light as a function of wavelength, permitting accurate analysis of color or accurate comparison of luminous intensities of two sources or specific wavelengths. The optical spectra measured by sensors 40 and 42 are subsequently transmitted to the controller 44, which compares the measured optical spectra to target optical spectra (stored in memory). This information, in combination with the known transmission, reflection and/or emission spectra of each of the primary color components contained in supply containers 15A–15Z, is used to determine the appropriate amounts of each color component which should be added to the reservoir 10 via actuation of valves 16A–16Z, respectively. Developed image sensor 40 senses the actual color of the developed image, and in turn provides an image feedback signal to controller 44, the signal being processed by conventional electronic circuitry in order to selectively control the operation of valves 16A–16Z. In order to maintain precise color control each selected developing material concentrate is preferably dispensed in a relatively small amount into the reservoir 10 where it is thoroughly mixed with the developing material therein to produce the desired customer selectable color developing material.

When only sensor 40 is used, color accuracy is maintained by monitoring and sensing the color of the developed image, typically printed as a test sheet which may be purged from the printing system and subsequently discarded. Alternatively, an area identified in an image as corresponding to the customer selectable color may be monitored and sensed in a manner similar to the process disclosed in U.S. Pat. No. 5,450,165, incorporated by reference herein, so as to obviate the need for the printing of a test image.

When sensors 40 and 42 are both used, the color of the test image formed on the final substrate is compared to the target color and used (if necessary) to adjust the target spectrum to which the output of sensor 42 is compared. In this way, test prints can be made infrequently while at the same time the color of the mixture of developing materials is being measured and corrected very frequently with input from reservoir sensor 42.

It is known to specify color in coordinate systems. One common system is known as CIELab, which measures color in terms of three components: L* roughly corresponds to a lightness-darkness scale, a* roughly corresponds to a red-green scale, and b* roughly corresponds to a yellow-blue scale. These coordinates provide a widely accepted measure (ΔE) of the difference between two printed colors, where ΔE is defined as the Cartesian distance between two colors, $(L^* a^* b^*)_1$ and $(L^* a^* b^*)_2$:

$$\Delta E = Sqrt[(a_1^* - a_2^*)^2 + (b_1^* - b_2^*)^2 + (L_1^* - L_2^*)^2]$$

The a* and b* coordinates can be recombined into color saturation, C*, and hue angle, h* by the following equations:

$$C^* = Sqrt[(a^*)^2 + (b^*)^2]$$

$$h^* = Atan[b^*/a^*]$$

These CIELab color coordinates can be computed from a full reflection spectrum using formulas published by CIE (Commission Internationale de I'Eclairage). Instruments such as the X-Rite 938 spectrodensitometer also exist which directly provide CIELab coordinates.

It has been found by empirical investigation that the L*, C*, and h* values are especially useful measures of printed color. These values can be used to adjust the components in the mixed toner tank, based on the following three observations:

1. Increasing the fraction of white toner increases lightness L* and decreases saturation C*;
2. Increasing the fraction of black toner decreases lightness L* and decreases saturation C*; and
3. Changing the ratio of two color toners (e.g., green and blue) primarily changes hue angle h*.

The method of the present invention starts with $(L^*, a^*, b^*)_1$ and $(L^*, a^*, b^*)_2$ the printed color specifications for two colored toners which may be mixed in the toner tank and with $(L^*, a^*, b^*)_t$, the color specification of the target color to be printed. It is important that these be color coordinates measured on the same surface where actual printed color, $(L^*, a^*, b^*)_n$, will be measured for the nth print. That is, the color printed on the final substrate, such as paper, transparency, or packaging material, etc. or on some surface internal to the printing process such as a photoreceptor or intermediate transfer belt, etc. The color of every print can be measured or as often as experience suggests.

The control system can learn how often to measure, by measuring at some interval, comparing color shifts to some maximum allowed color error, then increasing or decreasing the frequency of measurements as necessary to prevent unacceptably large drifts. A $\Delta E$ larger than 5 will generally be unacceptable. For some light colors, a $\Delta E$ as small as 2 may be unacceptable. The color control system may try to maintain $\Delta E<2$ for all colors or may include stored values of the maximum allowed $\Delta E$ for each color.

A key part of the invention is knowledge of the colors of the individual toners which are mixed to make the custom color. These colors must, in general be measured in advance and provided as part of the control software for the process.

After measuring $(L^*, a^*, b^*)_n$, $C^*_n$ and $\mathrm{Cos}[h^*_{ik}]=(a^*_i a^*_k+b^*_i b^*_k)/A_i A_k$ where i=1,2 and k=t,n and $A_1=\mathrm{sqrt}[(L^*_1)^2+(a^*_1)^2+(b^*_1)^2]$are calculated. $\mathrm{Cos}[h^*_{in}]$ measures color differences between the ith component color and the nth component color. $\mathrm{Cos}[h^*_{it}]$ measures color differences between the ith component color and the target color. If $\mathrm{Cos}[h^*_{1t}]<\mathrm{Cos}[h^*_{1n}]$ and $\mathrm{Cos}[h^*_{2t}]>\mathrm{Cos}[h^*_{2n}]$, then the current color is too close to component one's color and too for from component two's color. Therefore, the color correction algorithm of this invention would decrease the amount of component one on later prints and increase the amount of component two which is printed. This rule alone is sufficient to adjust toner concentrations if only two colors are combined, i.e., if no white or black is included in the mix. However, large changes in the amount of white or black in the mix may produce only a small change in h* while producing large changes in L* and C*.

When white or black is included in the mix, the above calculation is combined with comparisons of $C^*_n$ to $C^*_t$ and $L^*_n$ to $L^*_t$ to adjust the amount of white or black toner in the mixed developer, according to observations 1 and 2 above. That is, if the lightness and contrast of the $n^{th}$ print, $L^*_n$ and $C^*_n$, are both above (below) their target values, $L^*_t$ and $C^*_t$, then the amount of black in the mix is too low (high) and is increased (decreased) by the control system, 44. However, if $L^*_n$ is above (below) its target value, $L^*_t$, while $C^*_n$ is below (above) its target value, $C^*_t$, then the amount of white in the mix is too high (low) and is decreased (increased) by the control system, 44. This method thus applies to the cases included two colored toners, one colored toner and white or black and two colored toners and white or black.

Also encompassed within this invention is the combination of the above method with a feedback loop which keeps the total Developed Mass per Area (DMA) of the custom color constant, or within a desired range. In this way, changes in color coordinates L*, C*, and h* due to changes in DMA are eliminated and do not confuse the operation of the correction procedures described above. Control of DMA can be achieved by a sensor which measures DMA and a feedback loop which adjusts the voltage on the belt 100 and or the bias on the development roll 30 up or down to increase or decrease DMA. DMA can be measured by an infrared densitometer similar to that disclosed in commonly assigned patent U.S. Pat. No. 5,519,497, or by a capacitive sensor similar to that disclosed in commonly assigned U.S. Ser. No. 08/715,268, filed Sep. 16, 1996, or by any other method which is convenient.

The method of this invention can be implemented with sensor 42 which measures the color of the mixed toner and is connected to controller 44, described above. Controller 44 adjusts component concentrations until a target color is realized. The present invention can be used to adjust the target concentrations which the toner tank controller works to maintain. This will be necessary if the relation between printed color and toner color changes over time. Such changes might occur because of changing toner properties or because of changes in the toner tank sensor.

Sensor 40 may be used separately or in conjunction with sensor 42. When sensor 40 is used alone, the optical sensing device can be used to directly control the toner tank, thus eliminating the need for a sensor which measures the transmission spectrum of the toner in the tank.

The photometric method has been applied to the patches provided in the Pantone Color Selector 1000/Coated patch book. The Color Selector provides sample color patches and the proportions of printing inks mixed to print that patch. For the majority of cases examined, these rules correctly specify which components(s) would have to be changed and the direction of their change (i.e., increase or decrease) to move from one color to another.

It is, therefore, apparent that there has been provided in accordance with the present invention, a method in which a multi-component liquid xerographic developer is controlled by measuring the color of a printed patch or mixed developer that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. A system for providing an operative color developing material for developing an image for producing a customer selectable color output image, comprising:

a plurality of developing material supply dispensers, each containing a different color developing material concentrate corresponding to a basic color component of a color matching system, one of the color developer material concentrates being white;

a developing material reservoir for providing an operative supply of developing material for developing the latent image so as to generate the output print of a specified color, said reservoir having each of developing material supply dispensers coupled thereto;

a system for systematically dispensing a selective amount of developing material concentrate from at least a selected one of said developing material supply dispensers to said developing material reservoir for providing a selected amount of a selected basic color component to said supply of operative developing material;

a first optical sensing device for monitoring the color of a developed image produced by said operative developing material reservoir; and a control system coupled to said first optical sensing device for selectively actuating said systematic dispensing system in response to the sensed color of said developed image to adjust the operative color developing material so as to produce the customer selectable color output image, the customer selectable color being selected from a color guide illustrating a plurality of different colors, said color guide further provides a specific formulation of basic color components necessary to produce the selected color, and said control system being adapted to automatically blend predetermined amounts of basic color components in accordance with the specific formulation provided by said color guide and the control system is adapted to add selected amounts of basic color components to said supply of the selected color developing material in response to the sensed color thereof for correcting the selected color developing material to match the customer selectable color selected from the color guide.

2. The system of claim 1, wherein the system is in an electrostatic machine and the latent image is an electrostatic latent image and the developed image is a developed latent image.

3. The system of claim 2, wherein said first optical sensing device is a spectrophotometer.

4. The system of claim 2, wherein the developed image is on a printed output.

5. The system of claim 2, wherein the developed image is on a photoreceptor.

6. The system of claim 2, wherein the developed image is on an intermediate transfer member.

7. The system of claim 1, further comprising:

a second optical sensing device for monitoring the color of the operative developing material and coupled to the control system to adjust the color of the operative developing fluid to an operative developing material target value, wherein the customer selectable color output image is correlated with the developing material target value.

8. The system of claim 1, wherein said color matching system includes a Pantone® color matching system.

9. The system of claim 1, wherein CEILab color coordinates of the developed image are measured by the first optical sensing device and are used to match the customer-selected color.

10. The system of claim 9, wherein one of the color developer material concentrates is black.

11. The system of claim 9, wherein the control system is adapted to compare an optical spectrum of the developed image from said first optical sensing device to a target optical spectrum corresponding to said customer selectable color.

12. The system of claim 11, wherein CEILab color coordinates of the developed image are measured by the first optical sensing device and the coordinates are used to match the customer-selected color.

13. The system of claim 1, wherein one of the color developer material concentrates is black.

14. The system of claim 1, wherein the operative developing material is controlled so as to keep the developed mass per area of the developed image within a predetermined range.

15. A method for providing an operative color developing material for developing an image for producing a customer selectable color output image, comprising:

dispensing different color developing material concentrate from a plurality of developing material supply dispensers, each dispenser containing a different color developing material concentrate corresponding to a basic color component of a color matching system;

supplying an operative developing material to a developing material reservoir for providing an operative supply of developing material for developing the image so as to generate the output print of a specified color, said reservoir having each of developing material supply dispensers coupled thereto;

monitoring the color of a developed image produced by said operative developing material with a first optical sensing device; and selectively controlling the dispensed amount of developing material concentrate from at least a selected one of said developing material supply dispensers to said developing material reservoir for providing a selected amount of a selected basic color component to said supply of operative developing material with a control system coupled to said first optical sensing device for selectively actuating said systematic dispensing system in response to the sensed color of said developed image to adjust the operative color developing material so as to produce the customer selectable color output image, including:

comparing an optical spectrum of the developed image from said sensing device to a target optical spectrum corresponding to said customer selectable color; and adding selected amounts of basic color components to said supply of the selected color developing material in response to the sensed color thereof for correcting the selected color developing material to match the customer selectable color by using the color coordinates to match the customer-selected color by increasing the fraction of white toner to increase lightness and decrease saturation, increasing the fraction of black toner to decrease lightness and decrease saturation, and changing the ratio of two color toners primarily to change hue angle.

16. The method of claim 15, wherein monitoring the color of the developed image includes monitoring the developed image of a printed output on a substrate.

17. The method of claim 15, wherein monitoring the color of the developed image includes monitoring the developed image on a photoreceptor.

18. The method of claim 15, wherein monitoring the color of the developed image includes monitoring the developed image on an intermediate transfer member.

19. The method of claim 15, further comprising:

monitoring the color of the operative developing material and coupled to the control system to adjust the color of the operative developing fluid to an operative developing material target value with a second optical sensing device wherein the customer selectable color output image is correlated with the developing material target value.

20. The method of claim 19, wherein monitoring with the first optical sensing device as necessary to maintain desired print qualities; and monitoring with the second optical sensing device continually.

21. The method of claim 15, said monitoring step including:

measuring CEILab color coordinates of the developed image with the first optical sensor; and using the CEILab color coordinates to match the customer-selected color.

22. The method of claim 15, said monitoring step including:

measuring CEILab color coordinates of the developed image with the first optical sensor; and using the CEILab color coordinates to match the customer-selected color.

23. The method of claim 22, further comprising:

measuring the developed mass per area of the developed image; and said selectively controlling the dispensed amount of developing material concentrate includes keeping the developed mass per area of the developed image within a predetermined range.

24. A method for providing an operative color developing material for developing an image for producing a customer selectable color output image, comprising:

selecting the customer selectable color from a color guide illustrating a plurality of different colors;

providing a specific formulation of basic color components necessary to produce the selected color from said color guide;

dispensing different color developing material concentrate from a plurality of developing material supply dispensers, each dispenser containing a different color developing material concentrate corresponding to a basic color component of a color matching system;

supplying an operative developing material to a developing material reservoir for providing an operative supply of developing material for developing the image so as to generate the output print of a specified color, said reservoir having each of developing material supply dispensers coupled thereto;

monitoring the color of a developed image produced by said operative developing material with a first optical sensing device whereby the color coordinates of the developed image are measured;

selectively controlling the dispensed amount of developing material concentrate from at least a selected one of said developing material supply dispensers to said developing material reservoir for providing a selected amount of a selected basic color component to said supply of operative developing material with a control system coupled to said first optical sensing device for selectively actuating said systematic dispensing system in response to the sensed color of said developed image to adjust the operative color developing material so as to produce the customer selectable color output image; and adapting said control system to automatically blend predetermined amounts of basic color components in accordance with the specific formulation provided by said color guide and adding selected amounts of basic color components to said supply of the selected color developing material in response to the sensed color thereof for correcting the selected color developing material to match the customer selectable color selected from the color guide by increasing the fraction of white concentrate to increase lightness and decrease saturation, increasing the fraction of black concentrate to decrease lightness and decrease saturation, and changing the ratio of two color developer material concentrates primarily to change hue angle.

25. The method of claim 24, wherein the color coordinates are CIELab color coordinates.

* * * * *